US008807569B1

(12) United States Patent
Davis

(10) Patent No.: US 8,807,569 B1
(45) Date of Patent: Aug. 19, 2014

(54) ILLUMINATED BEAN BAG TOSS GAME

(76) Inventor: Rodney G. Davis, Janesville, WI (US)

( * ) Notice: Subject to any disclaimer, the term of this patent is extended or adjusted under 35 U.S.C. 154(b) by 172 days.

(21) Appl. No.: 13/424,419

(22) Filed: Mar. 20, 2012

(51) Int. Cl.
*F41J 5/02* (2006.01)
*A63B 63/00* (2006.01)
*A63B 43/06* (2006.01)

(52) U.S. Cl.
USPC ..... 273/371; 273/402; 473/570

(58) Field of Classification Search
USPC ..... 473/570; 273/371, 398–402
See application file for complete search history.

(56) References Cited

U.S. PATENT DOCUMENTS

| | | | | |
|---|---|---|---|---|
| 3,582,076 | A | 6/1971 | Keller | |
| 3,970,310 | A * | 7/1976 | Gryschuk | 273/375 |
| 4,923,201 | A | 5/1990 | Nichol et al. | |
| 4,927,160 | A | 5/1990 | Nichol et al. | |
| 5,536,017 | A * | 7/1996 | Salisian | 273/375 |
| D375,530 | S * | 11/1996 | Rudd | D21/303 |
| 5,704,612 | A * | 1/1998 | Kelly et al. | 273/402 |
| 7,607,666 | B1 * | 10/2009 | Studier | 273/400 |
| 7,661,679 | B2 * | 2/2010 | Mah et al. | 273/371 |
| 7,854,528 | B2 | 12/2010 | Segretto et al. | |
| 7,909,329 | B1 * | 3/2011 | Martinson | 273/330 |
| 8,157,265 | B2 * | 4/2012 | Conville et al. | 273/402 |
| 8,162,318 | B1 * | 4/2012 | Peterson et al. | 273/402 |
| 8,413,990 | B2 * | 4/2013 | Allshouse et al. | 273/371 |
| 2003/0030218 | A1 * | 2/2003 | Zucchi et al. | 273/371 |
| 2003/0116917 | A1 * | 6/2003 | Thiemann | 273/378 |
| 2010/0090407 | A1 * | 4/2010 | Lin | 273/371 |
| 2010/0164175 | A1 * | 7/2010 | Buchanan | 273/402 |
| 2010/0317470 | A1 * | 12/2010 | Cea et al. | 473/570 |

OTHER PUBLICATIONS

Cornhole Hole Lights. Cornhole.com http://holelights.com.

* cited by examiner

*Primary Examiner* — Mark Graham
(74) *Attorney, Agent, or Firm* — Robert C. Montgomery; Montgomery Patent & Design

(57) ABSTRACT

Provided is an illuminated toss game having at least one (1) game piece that is tossed into at least one (1) scoring hole located in a top surface of a playing platform. The toss game further includes a speaker and various lighting devices that are activated when a game piece is tossed through a scoring hole. To sense when a game piece passes through a scoring hole the toss game also includes a detector that emits an electrical signal that causes lights near the scoring hole to signal that a point has been scored. The toss game further includes an on-board battery, power and audio ON/OFF switches, and a controller that causes various lighting and sound effects to occur. Additionally, the game piece includes illumination lights.

1 Claim, 3 Drawing Sheets

ILLUMINATED BEAN BAG TOSS GAME

RELATED APPLICATIONS

There are currently no applications co-pending with the present application.

FIELD OF THE INVENTION

The presently disclosed subject matter is directed towards games. More particularly the subject invention is directed to an illuminated electronic beanbag toss game.

BACKGROUND OF THE INVENTION

Older people often remember with great fondness the games of their youth. Neighborhood children would often play tag, board games, baseball, bad mitten, horseshoes, and darts. While some of those games are still popular they are not as popular as they once were.

One (1) reason for the decline in popularity of older games is that today's children are influenced by fast action computer games, movies, and other such activities that incorporate sound and light effects. However, some of the older games combined elements of both competition and skill that are difficult to replicate on a computer. One (1) such game is the much loved game of beanbag toss. In beanbag toss, a bag filled with a material such as beans, corn kernels, shells, or other filler material is tossed from a toss line toward one or more targets, usually a hole in a board. A successful toss, when the bag passes through the hole, results in a score. By placing multiple different sized scoring holes through the board, different points can be awarded. Then, like in the game of darts, different ways to determine who won a game can be implemented: high score, first to a score, or the first to accumulate a given score are all possible.

The challenge of simply tossing a bag through a hole in a board should not be underrated. It can be remarkably challenging, and if it becomes too easy the challenge can be increased simply by moving the line further from the board. Since beanbag toss can be played in teams, using two (2) boards makes team play easier and the game overall faster.

In view of the foregoing a more modern version of the old bean bag toss game that incorporates lights and sounds would be beneficial.

SUMMARY OF THE INVENTION

The principles of the present invention provide for a modern version of the beanbag toss game and which incorporates lights and sounds to make the game more interesting and player friendly.

A toss game that is in accord with the principles of the present invention includes a target board having a flat surface with a target opening. The target board is illuminated by a plurality of board perimeter illumination lamps, while the target opening is illuminated by target perimeter illumination lamps. The target board is supported by a hinged rear support leg and by a hinged front support frame that fold under the target board. The toss game also includes a speaker, a game piece (preferably illuminated), and a detector that senses when the game piece enters the target opening. The first target perimeter illumination lamp signals when the game piece enters that target opening.

Beneficially, the target board includes a centerline hinge and a carrying handle, and the flat surface further includes a second target opening illuminated by a second target perimeter illumination lamp. Also beneficially, the first target perimeter illumination lamp and the second target perimeter illumination lamp have different colors.

In practice, the target board is supplied with a battery storage compartment that houses a first replaceable battery that selectively powers the board perimeter illumination lamps, and a first ON/OFF switch that controls the application of power from the first replaceable battery. Additionally, the toss game includes an audio ON/OFF switch that controls a signal that is applied to the speaker. The first target perimeter illumination lamp lights and/or flashes whenever a game piece passes through the first target opening while the board perimeter illumination lamps are lit during game play.

Detecting when a game piece enters the target opening is performed by a detector having an emitter and a receiver, beneficially photoelectric that form a detection field that spans the target opening. The detector provides an electric signal whenever a game piece passes through the target opening.

As noted, the game piece is beneficially illuminated. If so, the game piece includes an internal battery, a battery switch, and a fill media.

The toss game further includes a software operated controller module that controls the board perimeter illumination lamps and the target perimeter illumination lamps in response to the electric signal from the detector. The controller module can also drive an audio processor that is connected to the speaker and can control the board perimeter illumination lamps to illuminate and/or flash.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
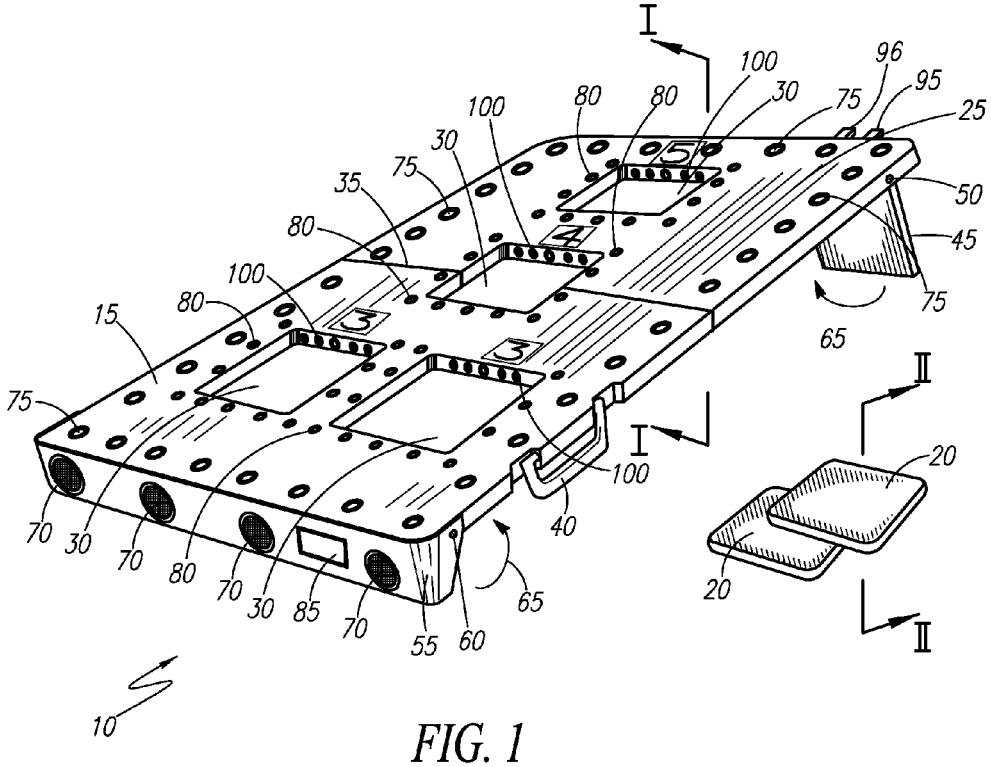
FIG. 1 is an isometric view of a beanbag toss game 10 that is in accord with the principles of the present invention.

10 beanbag toss game
15 target board
20 game pieces
25 flat surface
30 target opening
35 centerline hinge
40 carrying handle
45 rear support legs
50 first hinge mechanism
55 front support frame
60 second hinge mechanism
65 travel path arrows
70 speakers
75 board perimeter illumination lamps
80 target perimeter illumination lamp
85 battery storage compartment
90 first replaceable batteries

95 first ON/OFF switch
96 audio ON/OFF switch
100 detector
105 emitter
110 receiver
115 detection field
120 outer cloth covering
125 fill media
130 light-emitter
135 light rays
140 adhesive
145 control enclosure
150 zipper
155 second replaceable battery
160 second ON/OFF switch
165 controller module
170 audio processor
175 audio file memory module
180 perimeter illumination driver
185 target illumination driver
190 driver circuit

DETAILED DESCRIPTION OF THE PREFERRED EMBODIMENT

The best mode for carrying out the invention is presented in terms of its preferred embodiment, herein depicted within FIGS. 1 through 5, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The principles of the present invention are presented in terms of a beanbag toss game 10 embodiment depicted in FIGS. 1 through 5.

FIG. 1 presents an isometric view of the beanbag toss game 10, a game that includes elements of both skill and strategy and which is preferably played outdoors. The beanbag toss game 10 is played on two (2) identical target boards 15, only one (1) of which is shown for purposes of illustration, and a set of game pieces 20. While the game pieces 20 are shown and described as being beanbag-shaped that is not intended to be a limiting factor of the present invention as other shapes may also be used.

Still referring to FIG. 1 each target board 15 comprises a flat surface 25 having at least one (1) target opening 30 (four (4) are shown in FIG. 1). The flat surface 25 has a centerline hinge 35 and a carrying handle 40 that enable the target board 15 to be folded in half, carried and transported. The flat surface 25 is envisioned as being made from weather-resistant materials such as molded plastic, plastic-coated plywood, or the like.

The target board 15 is provided with two (2) rear support legs 45 (only one (1) of which is shown due to limitations of illustration) which are supported by first hinge mechanisms 50. The target board 15 is also provided with a front support frame 55 which is supported by a second hinge mechanism 60. The rear support legs 45 and the front support frame 55 fold inward as depicted by travel path arrows 65.

The front support frame 55 is provided with a series of speakers 70 which emit pre-recorded verbal announcements that are intended to enhance game enjoyment, such as during initial activation of power, as well as each scoring success. Additional details on the functionality of the speakers 70 are provided below. The target board 15 is also provided with a plurality of board perimeter illumination lamps 75 such as incandescent lamps, LED lamps, Neon lamps or the like. Additionally, the target board 15 is provided with target perimeter illumination lamps 80 around each of the target openings 30. As before, the target perimeter illumination lamps 80 can be from incandescent lamps, LED lamps, neon lamps or the like. It is envisioned that each target opening 30 is provided with a unique color perimeter illumination such as green, blue, red, or the like, so as to communicate which target opening 30 a user has scored through.

Still referring to FIG. 1, the front support frame 55 includes a battery storage compartment 85 for housing first replaceable batteries 90 (not shown in FIG. 1, but see FIG. 4) that supply operating power for elements attached to the target board 15. The first replaceable batteries 90 enable portable operation of the beanbag toss game 10 without reliance on outside power.

Figure 4:
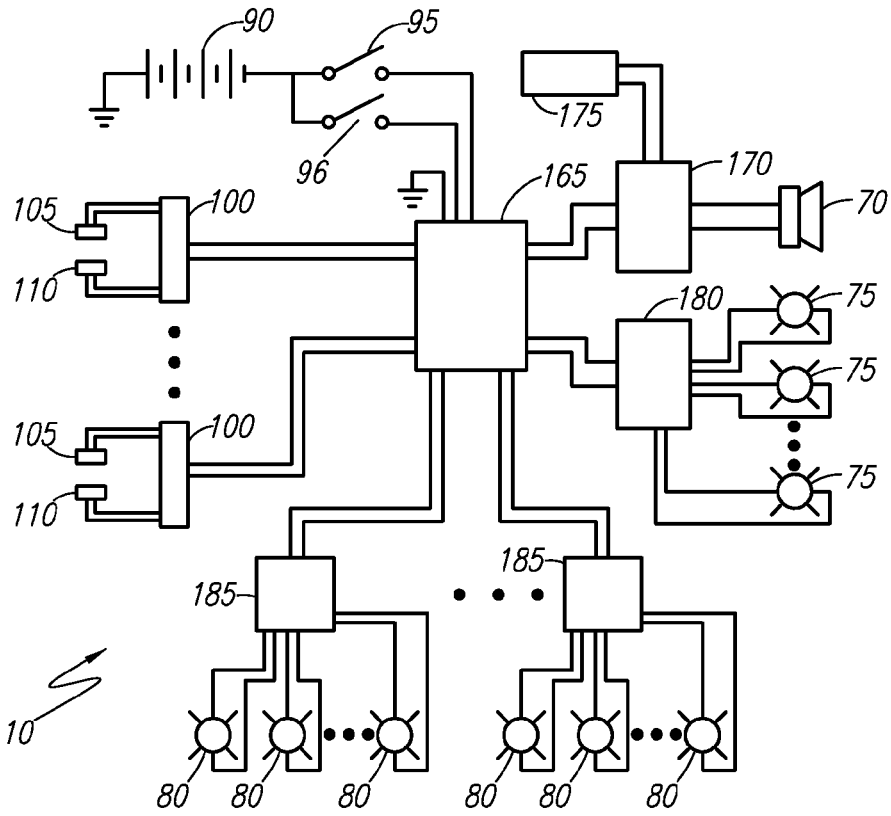
FIG. 4 is an electrical block diagram of the target board 15 shown in FIG. 2; and, FIG. 5 is an electrical block diagram of the game pieces 20 shown in FIGS. 1 and 3.

Referring now to both FIG. 1 and FIG. 4, the beanbag toss game 10 includes a first ON/OFF switch 95 that is located on the rear of the target board 15 to allow a user to control the game power. When the first ON/OFF switch 95 is OFF or when the first replaceable batteries 90 are depleted or not installed, the beanbag toss game 10 functions as a conventional beanbag toss game. The beanbag toss game 10 also includes an audio ON/OFF switch 96 that is adjacent the first ON/OFF switch 95. The audio ON/OFF switch 96 enables a user to turn off sound to operate the beanbag toss game 10 in a silent mode if desired.

Still referring to both FIG. 1 and FIG. 4, each target opening 30 includes a detector 100 for detecting when a game piece 20 enters the target opening 30. Further description of the detectors 100 is provided below. The detectors 100 enable enhanced playing enjoyment of the beanbag toss game 10 by causing the target perimeter illumination lamps 80 to light and flash whenever a game piece 20 passes through a target opening 30. It is also envisioned that the board perimeter illumination lamps 75 and the target perimeter illumination lamps 80 would illuminate in a continuous or a sequential flashing manner during game play.

Referring now to both FIG. 1 and FIG. 5, the game pieces 20 are also provided with internal illumination as described subsequently. Such illumination in conjunction with the audio sounds provide more interesting and attractive game play and are particularly beneficial should the beanbag toss game 10 be played at night or during other periods of low ambient light. Indeed, at night the illumination provided by the board perimeter illumination lamps 75, the target perimeter illumination lamps 80, and the game pieces 20 can serving as the only illumination and such is envisioned as increasing the level of fun and excitement.

Figure 2:
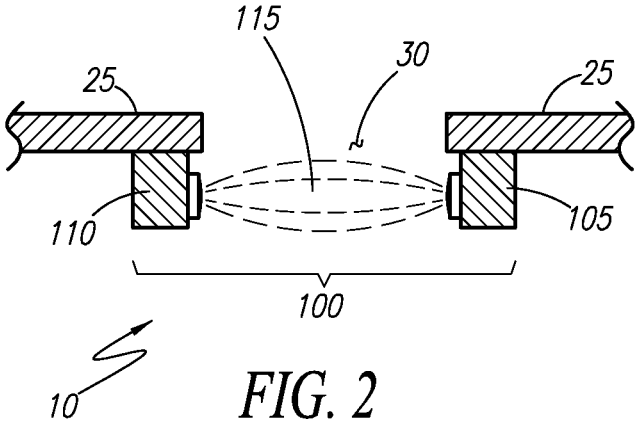
FIG. 2 is a sectional view of the target board 15 of the beanbag toss game 10 illustrated in FIG. 1.

FIG. 2 is a sectional view of the target board 15 taken along line I-I of FIG. 1 and which is particularly helpful in understanding the detector 100 and its relationship to the flat surface 25 and the target opening 30. The detector 100 comprises a photoelectric emitter 105 and a photoelectric receiver 110. However, the emitter 105 and receiver 110 may operate on other principles such as ultrasonic, radioactive, and capacitive and the like can be used with equal effectiveness. The emitter 105 and the receiver 110 form a detection field 115 which spans the opening of the target opening 30 and which provides an electric signal whenever an object such as the game pieces 20 (see FIG. 1 and FIG. 3) passes through. The emitter 105 and the receiver 110 should be located so as not to impede or assist the passage of the game pieces 20 through the target opening 30.

Figure 3:
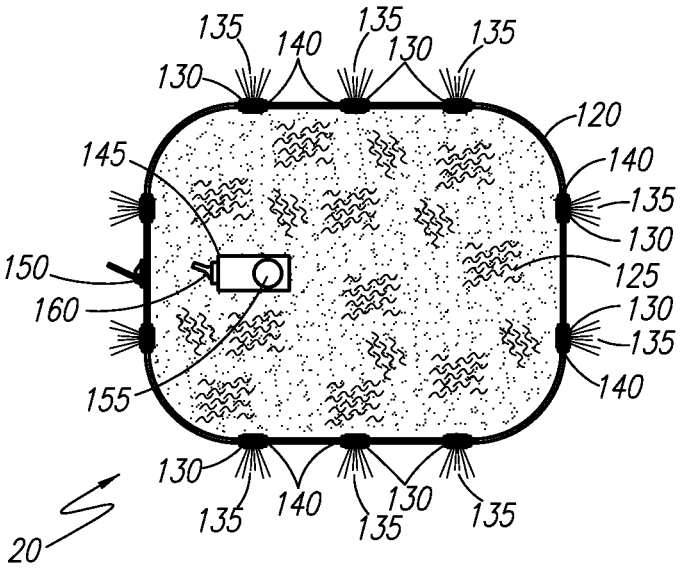
FIG. 3 is a sectional view of the game pieces 20 taken along line II-II of FIG. 1.

FIG. 3 presents a sectional view of the game pieces 20 taken along line II-II of FIG. 1. As shown, the game pieces 20 have an outer cloth covering 120 of a heavy duty material such as nylon, canvas, denim or the like. Most of the interior space is filled with a fill media 125 such as corn kernels, beans, sand, small pebbles or the like. A series of light-emitters 130 such as light-emitting diodes (LED's) are located inside the outer cloth covering 120 so as to shine through the outer cloth covering 120 to produce exterior light rays 135. The light-emitters 130 are held in place with adhesive 140 or secured by another means such as sewing. The light-emitters 130 are connected to a control enclosure 145 located inside the outer cloth covering 120 and near a zipper 150. The control enclosure 145 houses a second replaceable battery 155 and a second ON/OFF switch 160. The user can control the operation of the light-emitters 130, as well as replace the second replaceable battery 155 without upsetting the aerodynamic and exterior characteristics of a conventional bean bag.

Referring now to FIG. 4, which is an electrical block diagram of the target board 15. Operating power for the target board 15 is derived from the first replaceable batteries 90 as controlled by the first ON/OFF switch 95. Switched power is routed to a controller module 165. The controller module 165 includes a microcontroller such as a basic stamp module that operates in accord with software programs, such as an Arduino-based platform that uses the Arduino programming language. The controller module 165 further includes hard wiring, glue logic, a relay or the like. Such various control based themes are well known in the art and are not intended to be a limiting factor of the present invention.

Inputs to the controller module 165 include the detector 100 and its emitter 105 and the receiver 110. The number of detectors 100 correspond to the number of target openings 30 (see FIG. 1). Outputs from the controller module 165 drive an audio processor 170, which connect both to speakers 70 as well as to an audio file memory module 175. Example content of the audio file memory module 175 may include files for tunes such as "LET'S PLAY", "GOOD SHOT", "RIGHT DOWN THE MIDDLE", "CHEERING SOUNDS", "THAT'S A WINNER", and the like.

Another output from the controller module 165 powers a perimeter illumination driver 180 which drives the board perimeter illumination lamps 75. The perimeter illumination driver 180 provides steady state illumination, random flashing, steady state flashing, sequential flashing and the like. The controller module 165 also provides outputs to a series of target illumination drivers 185 for each of the target openings 30 (see FIG. 1). It is envisioned that each target illumination driver 185 provides illumination to a respective target opening 30 which in turn comprises a unique color perimeter illumination such as green, blue, red, or the like, so as to communicate which target opening 30 the user has scored through. The activation of the target illumination driver 185 is controlled by the detector 100 within each target opening 30. As such, the light from the target perimeter illumination lamps 80 correspond to passage of a throwing game piece 20 through a target opening 30.

Figure 5:
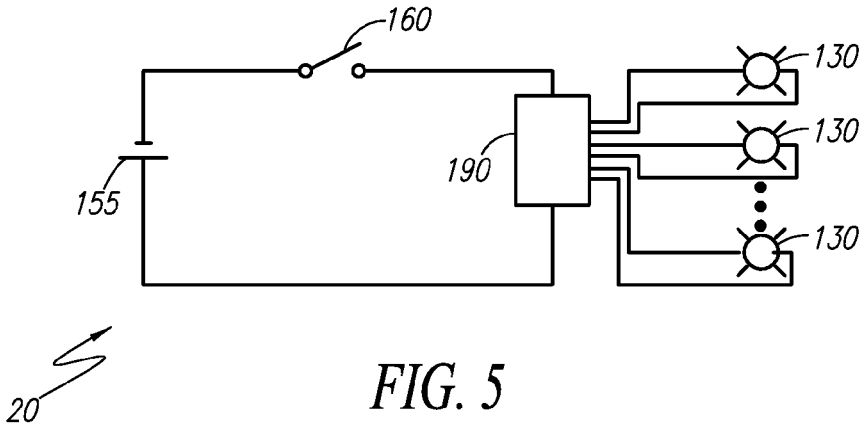

Referring now to FIG. 5, an electrical block diagram of the game pieces 20, power from the second replaceable battery 155 is routed through the second ON/OFF switch 160 and into a driver circuit 190. The output of the driver circuit 190 drives the light emitters 130. The driver circuit 190 beneficially provides for continuous illumination, random illumination, sequential illumination and the like.

It is envisioned that other styles and configurations of the present invention can be easily incorporated into the teachings of the present invention. While only one particular configuration is shown and described, such is for purposes of clarity and disclosure and not by way of limitation of scope.

The preferred embodiment of the present invention can be utilized by the common user in a simple and effortless manner with little or no training. It is envisioned that the bean bag game 10 would be constructed in general accordance with FIG. 1 through FIG. 5. It is also envisioned that the target board 15 would be made of weather-resistant plywood or plastic using well known forming and manufacturing methods. The various electronic components as aforementioned described would be placed on or in the target board 15 or the game pieces 20 respectively and wired together in accord with the block diagrams of FIG. 4 and FIG. 5. The target board 15 and the game pieces 20 would be supplied with first replaceable batteries 90 and a second replaceable battery 155. A pair of target boards 15 would be located in an outdoor or other appropriate environment a suitable distance apart. The first ON/OFF switch 95, the audio ON/OFF switch 96, and the second ON/OFF switch 160 would be activated. At this point in time, the bean bag game 10 is ready for use.

During actual use of the bean bag game 10, teams of player(s) would take turns trying to throw the game pieces 20 through the target openings 30. Various points are awarded for successful attempts. Scoring continues for a predetermined number of rounds or until a predetermined point level is reached thus determining a winner or winning team. During such play, the bean bag game 10 provides illumination via the board perimeter illumination lamps 75 and the target perimeter illumination lamps 80 while also provided special scoring illumination via the detector 100 and target perimeter illumination lamps 80 and audible sounds via the speakers 70. When finished with play, the target board 15 and the game pieces 20 are deactivated. The rear support legs 45 and the front support frame 55 are folded inward and the target board 15 is folded in half and transported via the carrying handle 40 to a suitable storage location.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A toss game, comprising:

at least one target board comprising:

a flat surface with a first target opening and a second target opening; and, a centerline hinge and a carrying handle;

wherein said target board can be folded along said centerline hinge and carried by said handle;

a plurality of board perimeter illumination lamps around said target board;

a battery storage compartment housing a first replaceable battery for selectively supplying power to said plurality of board perimeter illumination lamps;

a first ON/OFF switch controlling power from said first replaceable battery;

a first target perimeter illumination lamp for illuminating said first target opening with a first color;

a second target perimeter illumination lamp for illuminating said second target opening with a second color;

at least one rear support leg attached by a rear hinge to said target board;

a front support frame attached by a front hinge to said target board;

a speaker having an audio processor;

an audio ON/OFF switch for controlling a signal applied to said speaker;

at least one game piece, each comprising:

a bag having fill media and at least one game piece illumination source disposed within said bag;

a zipper fastener disposed on said bag selectively granting access into said bag; and, a second replaceable battery and second replaceable battery switch to selectively supply power to each game piece illumination source;

a detector for at least one of said first target opening and said second target opening, each having a photoelectric emitter and photoelectric receiver forming a detection field which spans said first or second target opening and which provides an electric signal whenever said at least one game piece passes through said first target opening or said second target opening, wherein each detector is positioned on a lower surface of said target board and at a perimeter edge of said first and second target opening so as to not impede or assist passage of an object therethrough; and, a software operated controller module that controls said audio processor, said board perimeter illumination lamps, and said first target perimeter illumination lamp in response to said electric signal;

wherein said software operated control module controls said perimeter illumination driver to cause said board perimeter illumination lamps to illuminate in a continuous and a sequential flashing manner;

wherein said first target perimeter illumination lamp signals when said detector detects said at least one game piece entering said first target opening;

wherein said second target perimeter illumination lamp signals when said detector detects said at least one game piece entering said second target opening;

wherein first target perimeter illumination lamp lights in said continuous and said sequential flashing manner whenever said at least one game piece passes through said first target opening;

wherein second target perimeter illumination lamp lights in said continuous and said sequential flashing manner whenever said at least one game piece passes through said second target opening;

wherein said board perimeter illumination lamps illuminate during game play; and, wherein said rear support leg and said front support frame fold under said target board.

* * * * *